US005377861A

United States Patent [19]

Landis

[11] Patent Number: 5,377,861

[45] Date of Patent: Jan. 3, 1995

[54] CONTAINER CLOSURE WITH EXTERNAL RIBS

[75] Inventor: H. Richard Landis, Oak Lawn, Ill.

[73] Assignee: Landis Plastics, Inc., Chicago Ridge, Ill.

[21] Appl. No.: 3,773

[22] Filed: Jan. 13, 1993

[51] Int. Cl.[6] ..... B65D 43/03

[52] U.S. Cl. ..... 220/380; 220/306; 220/355; 206/508; 206/519

[58] Field of Search ..... 220/306, 355, 356, 380; 206/508, 515, 519

[56] References Cited

U.S. PATENT DOCUMENTS

| | | | |
|---|---|---|---|
| 3,112,841 | 12/1963 | Martinelli | 220/380 |
| 3,651,981 | 3/1972 | Kinney | 220/306 X |
| 4,051,951 | 10/1977 | Smith | 220/380 X |
| 4,234,100 | 11/1980 | Chabot | 220/306 |
| 4,311,238 | 1/1982 | Smith | 220/306 X |
| 4,512,493 | 4/1985 | Von Holdt | 220/306 |
| 4,518,097 | 5/1985 | Milton et al. | 220/307 |
| 4,703,857 | 11/1987 | Jahnen et al. | 220/380 X |
| 4,817,801 | 4/1989 | Schwaikert | 220/380 X |
| 4,826,039 | 5/1989 | Landis | 220/380 |
| 4,872,586 | 10/1989 | Landis | 220/307 |

*Primary Examiner*—Allan N. Shoap
*Assistant Examiner*—Vanessa Caretto
*Attorney, Agent, or Firm*—Fitch, Even, Tabin & Flannery

[57] ABSTRACT

An injection molded closure and a container has a closure with external ribs for preventing jamming together of adjacent closures in stacked relation, and facilitating self-alignment of stacked closures. The closure has a central circular panel and a sidewall extending generally upwardly therefrom. The sidewall has upper and lower vertical portions with a lateral offset portion extending therebetween, which define a plug-like portion of the closure. Upon engagement of the closure with a container, the plug-like section is inserted into the container opening. The ribs are spaced peripherally about the outside of the closure and include an upper closure-engaging surface for contact with the rim of another closure stacked therebelow, and a lower closure-engaging surface for contact with the lateral offset portion of the other closure stacked therebelow. The ribs prevent an upper closure from wedging or jamming into the plug-like portion of another closure therebelow, since the ribs will continue to engage with the upper rim and lateral offset portions of the lower closure to prevent downward movement of the upper closure into the plug-like portion of the lower closure. The outer ends of the lower closure-engaging rib surfaces are rounded, and the intersection of the lower portion of the sidewall and the lateral offset portion of the sidewall is rounded. These rounded surfaces bear and cam against one another to provide self-centering of non-centered closures.

20 Claims, 2 Drawing Sheets

CONTAINER CLOSURE WITH EXTERNAL RIBS

FIELD OF THE INVENTION

The present invention relates to injection molded closures, and in particular, to such closures having deep plugs used in closing dairy containers containing diary products.

BACKGROUND OF THE INVENTION

Many dairy products, such as cottage cheese, sour cream, chip dip and the like are packaged in plastic containers having a complementary plastic lid or closure which engages with and seals the container. U.S. Pat. No. 4,826,039 and 4,872,586 disclose a container closure that is injection molded and designed to be used with the pre-existing conventional packaging equipment that had been used with automatic filling and capping equipment to place thermoformed closures onto the filled plastic containers. The dairies that use this equipment with thermoformed closures do want to replace their existing filling and capping equipment merely to switch from thermoformed closures to the injection molded closures. The thermoformed closures or lids are made by a die forcing a plastic sheet into the desired plug configuration, which has an enlarged sealing bead adjacent the bottom of the plug. The edges of the thermoformed sheet are later rolled to form the closure rim having a depending rim skirt with a generally circular cross-section. These thermoformed lids are nested in stacks from which they are dispensed. In the stack, the edges of the adjacent rim skirts are spaced from each other. That is, the outer skirts of the thermoformed containers do not extend downwardly as far as the plug portions. The nesting surfaces of adjacent thermoformed closures hold closures with this space between adjacent skirts; and it is into this space between adjacent skirts that a pair of mechanical fingers on a capping machine are inserted to remove the lowermost closure from the stack. With closures of this type, it is important that adjacent closures in the stack do not become askew or tilted with respect to one another, resulting in a relatively large gap between skirts on adjacent closures on one side of the stack and little or no gap between these adjacent closures on the other side of the stack. The mechanical fingers employed in automated packaging require generally uniform spacing between adjacent stacked closures for successful operation, and askew closures may cause obstruction of the mechanical fingers, resulting in production interruption and possibly equipment damage. U.S. Pat. No. 4,826,039 discloses a closure which, when stacked, maintains adjacent, stacked closures level with respect to one another, to provide generally uniform spacing between adjacent closures about their periphery.

In this patented closure, a central panel of the plug portion has a circular array of vertically extending ribs projecting upwardly from the central panel. If a closure begins to shift laterally relative to another closure in the stack, it will be supported against tilting by engaging supporting ribs on the closure therebelow. More specifically lower nesting surfaces on an offset in the upstanding sidewall of the plug-like portion will engage ribs on the rim of the closure therebelow. In this canted or inward position of the top lid, the ribs supported the upper lid from dropping further to the extent that caused its rim skirt to close or to substantially narrow the gap or space, into which the mechanical fingers need to move. If gap or space was allowed to become too narrow, the mechanical fingers would hit the inclined skirt wall and not remove the lid. When the upper lid shifted inwardly and was slightly canted enough to rest on the adjacent ribs of the lower lid, the space between adjacent skirts was still large enough to accept the mechanical fingers. Thus, the ribs functioned to prevent closure jamming.

It is preferred to support the closures in the stack by the continuous, circular nesting surface on the container rim rather than support a stack of closures on the small, top edges of the ribs. It will be appreciated that these closures are often shipped in large cartons and that cartons may be placed on top of each, and thereby cause a considerable downward force that would tend to force the top edges of the ribs into the panel of the overlying closure. Also, the closures should be capable of withstanding a drop test simulating the dropping of a carton full of stack closures, e.g. simulating a drop of the carton from a truck or the like for about four feet.

While the injection molded closures of the kind taught by U.S. Pat. No. 4,826,039 are commercially successful and in widespread use, the ribs on the top panel were annoying to people who picked up the closures two at a time with their hands and cut their fingers on the sharp, top edges of the ribs. It sometimes occurs in the dairy that a small short run will be capped manually by workers using their hands to place the lids onto the containers. In other instances, the capping machine may not have successfully capped the container with a closure, and a person will manually place a closure on that container to manually cap the closure. Persons who handled these closures wore leather gloves in some instances or put bandages on their fingertips to prevent their fingertips from being cut by the sharp, upper edges of the ribs. While the sharp edges of the ribs could be blunted to prevent cutting of fingers, the ribs still suffered the shortcoming of being potential dust collectors.

Furthermore, the ribs on the upper closure surface may detract from the aesthetic appearance of the closure and make it difficult to print onto the closure. The ribs on the upper closure surface also make it difficult to wipe spillage off of the closure surface.

It is desirable to provide a closure which can be formed by injection molding and having means for preventing both jamming of adjacent closures, with the closure also providing a smooth upper closure panel to facilitate wiping away of spillage on the closure and providing good aesthetic appearance to the consumer.

SUMMARY OF THE INVENTION

In accordance with the present invention, an injection molded plastic closure for dairy products is formed with a plurality of peripherally spaced, integral anti-jamming ribs on its underside. The anti-jamming ribs of a given stacked closure will contact the upper surface of the closure therebeneath when the overlying lid shifts laterally from its fully nested position, with the ribs being configured in a manner which maintains generally uniform spacing between adjacent stacked closures about their periphery and maintains adjacent stacked closures level with respect to one another. That is, the ribs preventing a wedge-type of locking engagement between adjacent lids and a riffling of the stack when a lid is askew, will generally cause a self-centering of the askew lid with the rest of the lids in the stack.

In accordance with the preferred embodiment of the invention, the closure comprises an encircling upper rim surface and a recessed central circular panel or disk, with a sidewall extending between the upper rim and the central panel which sidewall has offset portion radially inwardly of the rim to the recessed central circular panel. The double step-down sidewall comprises an upper vertical annular wall section, a horizontal annular shelf, and a lower vertical annular wall section. The upper annular wall section depends vertically downwardly from the inner edge of the annular upper rim, and terminates at the horizontal annular shelf. The horizontal annular shelf extends radially inwardly from the lower end of the upper annular wall section and terminates at the lower annular wall section. The lower annular wall section depends vertically downward from the inner edge of the horizontal shelf and terminates at the central circular panel or disk. Thus, the double step-down of the sidewall from the upper rim to the central circular panel recesses the circular panel with respect to the upper rim to define an upwardly facing cavity. The sidewall and circular panel form the plug-like section of the lid to be received.

A peripheral skirt extends downwardly from the radially outward edge of the annular upper rim, with the skirt having a radially inward retention bead near its lower end. The container to which the closure is applied has a radially outward retention bead at the upper end of its sidewall. Upon application of the closure with the container, the upper end of the container is received between the peripheral skirt and the upper annular wall, with the radially outward bead at the upper end of the container sidewall sliding below and engaging the underside radially inward bead of the closure skirt to retain the closure with the container.

For the purpose of preventing the jamming of lids and to keep the lids centered in the stack, a plurality of peripherally spaced rib means extend radially outwardly from the underside of the closure sidewall and have an upper closure-engaging surface for contact with the encircling rim upper surface of another closure therebelow and have a lower closure-engaging surface for contact with the lateral shelf of said other closure therebelow. The ribs prevent the lower sidewall portion of a closure from sliding down into wedged engagement with the lower sidewall portion of another closure therebelow.

In accordance with a preferred embodiment of the invention, the intersection of the lateral shelf and lower sidewall portion is arcuate to define a lower self-aligning surface, and the outward end of the lower closure-engaging surface is arcuate to define an upper self-aligning surface. When two closures are in non-centered stacked relation, the upper self-aligning surface of the upper closure, which surface is defined by the ribs, bears or cams against the lower self-aligning surface of the lower closure, which surface is defined by the closure sidewall, to facilitate self-centering of the closures with respect to one another particularly when the stack is rifled in order to provide the force to realign the non-centered lids.

BRIEF DESCRIPTION OF THE DRAWINGS

In the drawings, wherein like elements are referenced alike.

DETAILED DESCRIPTION OF THE PREFERRED EMBODIMENTS

Figure 1:
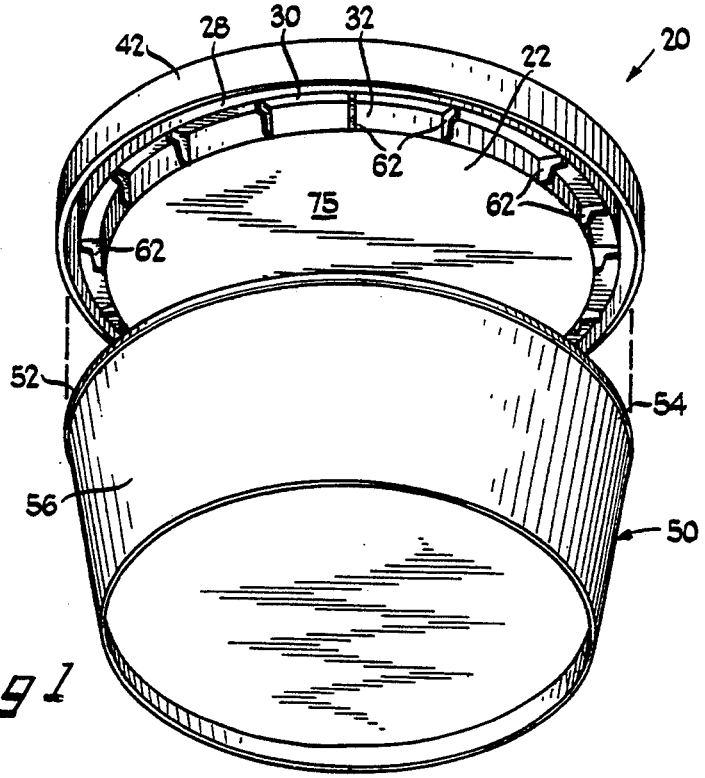
FIG. 1 is a perspective view of a closure embodying various features of the present invention, shown spaced from a container.

A closure embodying various features of the present invention is illustrated in FIGS. 1-5 and referred to generally by reference numeral 20. The closure 20 comprises a central, plug-like portion with a recessed central circular disk or panel section 22. Encircling the plug-like portion is an encircling annular upper rim 24, with a sidewall 26 extending between the upper rim 24 and the central circular panel 22.

The sidewall 26 is offset, or stated differently, steps down radially inwardly of the rim 24 to the recessed central circular panel 22. The preferred embodiment is a step-down sidewall 26 which comprises an upper annular, vertical sidewall section 28, a lateral offset annular shelf 30, and a lower annular, vertical sidewall section 32. In the illustrated embodiment of FIGS. 1-5, the upper annular sidewall section 28 depends vertically downwardly from the inner edge 34 of the annular upper rim 24, and terminates at the lateral offset annular shelf 30. The lateral offset annular shelf 30 extends radially inwardly from the lower end 36 of the upper annular sidewall section 28 and terminates at the lower annular sidewall section 32. The lower annular sidewall section 32 depends vertically downwardly from the inner edge 38 of the lateral offset shelf 30 and terminates at the central circular panel or disk 22. Thus, the step-down of the closure sidewall 26 from the upper rim 24 to the central circular panel 22 recesses inwardly the circular panel 22 with respect to the upper rim 24 to define an upwardly facing cavity 40.

For the purpose of retaining the closure on the container, the closure has a peripheral skirt 42 which depends downwardly from the radially outward edge 44 of the annular upper rim 24, with the skirt 42 having a radially inward retention bead 46 near its lower end 48.

Figure 6:
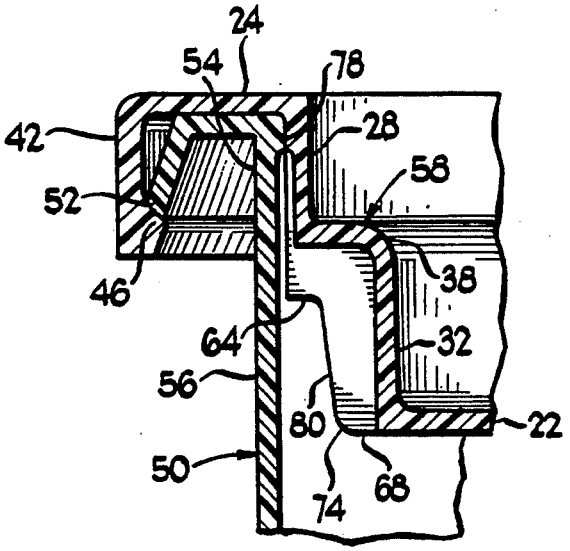
FIG. 6 is a view similar to FIG. 3 with the closure applied to the container rim.

The container 50, to which the closure is applied, has a radially outward bead or projection 52 at the upper end 54 of its container sidewall 56, which defines an open mouth. Upon application of the closure 20 to the container 50, the upper end 54 of the container 50 is received between the peripheral skirt 42 and the upper annular sidewall portion 28 of the closure 20, with the radially outward bead 52 at the upper end 54 of the container sidewall 56 engaging with the radially inward retention bead 46 of the closure skirt 42 to retain the closure 20 on the container 50 in a generally sealed relationship. As best seen in FIG. 6, the radially outward bead or project 52 engages the upper sidewall portion 28, the upper rim 24 and the skirt 42 to seal the container contents against leaking from the container. The closure sidewall 26 and circular panel 22 define a plug-like section, referred to generally by reference numeral 58, which is received in the open mouth of the container 50 for sealing engagement with the container sidewall 56.

Figure 4:
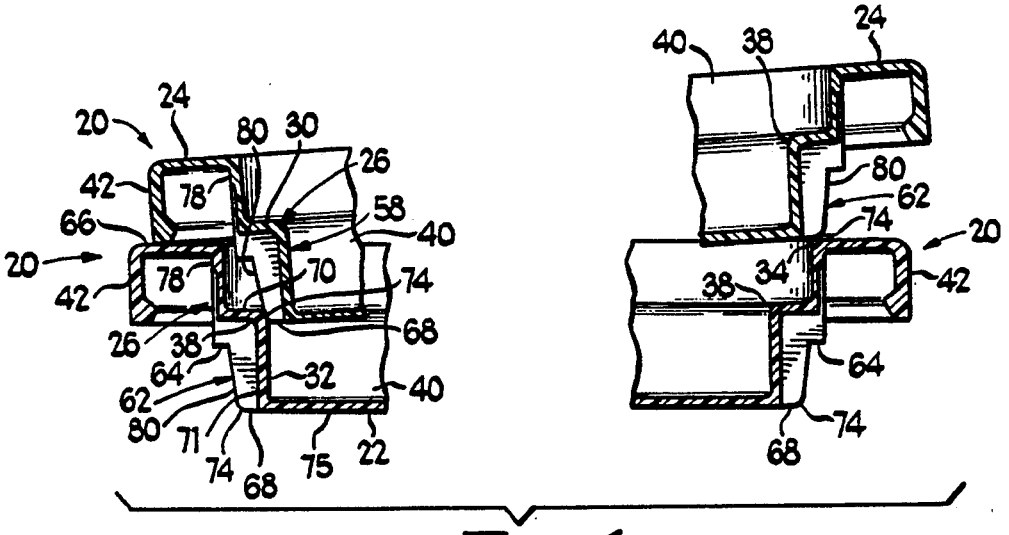
FIG. 4 is a fragmentary cross-sectional view of two closures embodying various features of the present invention, shown in askew stacked relation.

There is a need for the closures 20 to have an anti-jamming feature or means that prevents the stacked closures from jamming, as shown in the left portion of FIG. 4 in which the left end of the upper closure has slid inwardly sufficiently that the skirt 42 on the upper lid has dropped to engage the rim of the underlying lid, thereby eliminating the space or gap 72 (FIG. 5) into which the mechanical fingers of the automatic capping apparatus must move. With the closure in the position shown in FIG. 4, the mechanical finger will hit the depending skirt 42 of the upper closure and cause a jamming, and a consequent failure to remove the lower closure and probably subsequent closures on the continual cycling of the capping apparatus. While the closures of the kind disclosed in aforementioned patent had anti-jamming ribs, these were positioned to cause cuts on the fingers when handled manually, and to collect dust.

In accordance with the present invention, there is provided an anti-jamming means which prevents the jamming of lids and keeps the lids centered and with their peripheral skirts 42 spaced apart to provide a large enough gap 72 into which the mechanical fingers may be inserted. Herein, the anti-jamming means is in the form of ribs 62 which are formed on the lower, outer peripheral surface of the plug-like portion. As shown in FIG. 6, the ribs 62 will be disposed on the underside of closure and hidden down within the container when the closure is applied. This is in contrast to the patented closure in which the ribs are exposed at the top side of the panel.

Figure 5:
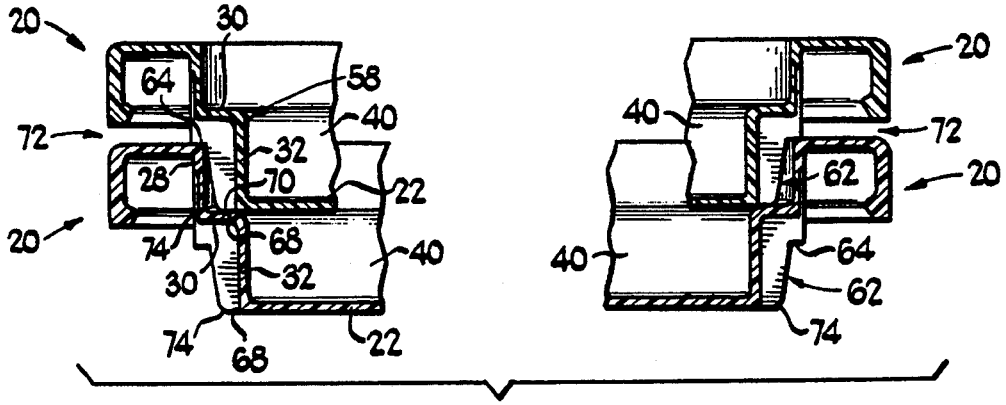
FIG. 5 is a fragmentary cross-sectional view of two closures embodying various features of the present invention, shown in properly stacked relation.

A plurality of peripherally spaced ribs or rib means 62 extend radially outwardly from the closure sidewall 26. The rib means 62 are preferably narrow ribs or tabs, which require relatively little additional plastic. As best seen in FIG. 5, the rib means 62 preferably include an upper closure-engaging surface 64 which contacts the upper end 34 of the upper sidewall portion 28, or the upper surface 66 of the annular encircling upper rim 24 (which is integral with the upper end of the closure sidewall), of another closure 20 therebelow when two closures 20 are properly stacked. The rib means 62 preferably further include a lower closure-engaging surface 68 which contacts the upper surface 70 of the lateral shelf 30 of the other closure 20 therebelow when the two closures 20 are stacked. The upper surface 70 of the lateral shelf 30 thus serves as an upper nesting surface on which the lower closure-engaging surface 68 of the rib means 62 rests or nests to prevent wedged engagement of the closure with another closure therebelow.

Figure 2:
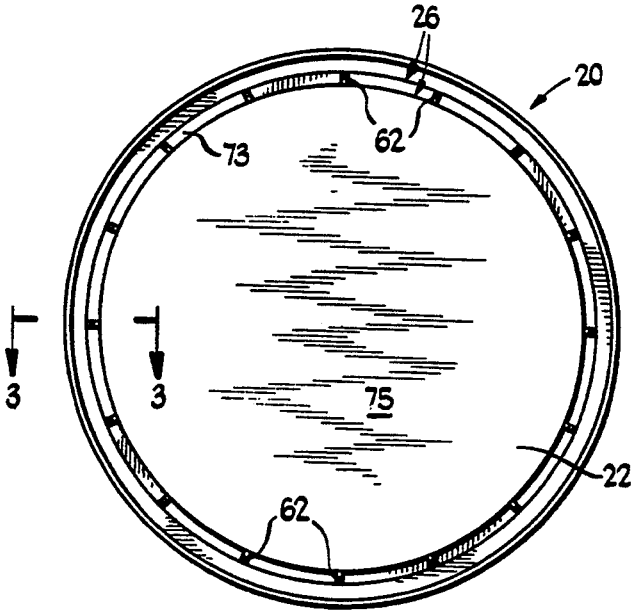
FIG. 2 is an elevational view of the underside of the closure of FIG. 1.
Figure 3:
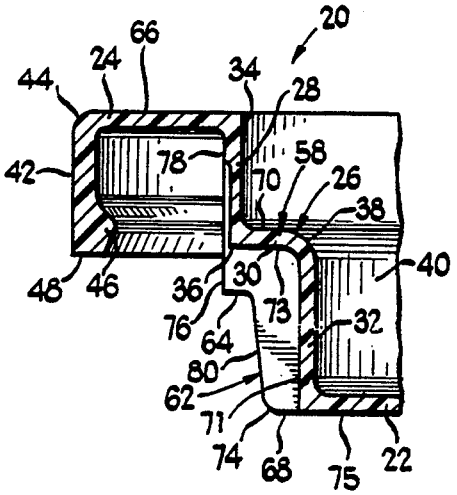
FIG. 3 is an enlarged, fragmentary cross-sectional view of the closure taken along line 3—3 of FIG. 2.

As best seen in FIGS. 1–3, the rib means 62 of the preferred embodiment is shown as a narrow rib integral with both the outer surfaces of the lower sidewall portion 32 and lateral offset portion 30 of the closure sidewall 26. The rib means 62 extend radially outwardly from the outer surface 71 of the lower sidewall portion 32 of the closure 20 and depend downwardly from the lower surface 73 of the lateral offset portion 30.

The lower closure-engaging surface 68 of the rib means 62 preferably extends radially outwardly from the outer surface 71 of the lower sidewall portion 32 and co-planar with the lower surface 75 of the central circular panel 22. Thus, the lower closure-engaging surface 68 of the rib means 62 is essentially a narrow outward continuation of the lower surface 75 of the central circular panel 22. The outwardmost end 74 of the lower closure-engaging surface 68 of the rib means 62 is preferably rounded or arcuate for self-aligning reasons which will be explained in detail further below.

The upper closure-engaging surface 64 of the rib means 62 is preferably horizontal and is spaced downwardly from the lower surface 73 of the lateral offset portion 30 of the sidewall 26. The outermost upper edge 76 of the rib means 62 is preferably coextensive with the outer surface 78 of the upper sidewall portion 28. That is, the outermost upper rib edge 76 preferably depends vertically downwardly from the lower surface 73 of the lateral offset portion 30 of the closure sidewall 26, not extending outwardly beyond the outer surface 78 of the upper sidewall portion 28. The outer surface 78 of the upper sidewall portion 28 bears against and has a sealing engagement with the inner annular wall surface of the container mouth. Extension of edge 76 outwardly beyond the outer surface 78 of the upper sidewall portion 28 would result in interference with the upper end 54 of the sidewall 56 of a container 50 when the closure 20 is engaged with the container.

The rib means has a tapered intermediate section 80 which extends at an angle from the upper closure-engaging surface and tapers inward to the rounded outwardmost end 74 of the lower closure-engaging surface 68. Thus, the lower closure-engaging surface 68 is offset laterally and offset vertically from the upper closure-engaging surface 64. The rounded edge 74 and the tapering of the intermediate section 80 facilitates self-aligning of stacked closures, as will be described further below.

Referring again to FIG. 5, it can be seen that the rib means 62 serve to maintain the gap 72 between the peripheral skirts 42 of an upper and lower closure 20 in properly stacked relation. The rib means are designed so that the gap 72 can accommodate the mechanical fingers of automated packaging equipment which automatically remove a closure 20 from the stack. It is important that the closures 20 be maintained in stacks in a manner which allows the ready release and handling of a closure by the packaging equipment. In this regard, it is important that there be adequate spacing maintained between the lower end 48 of the skirt 42 of an upper closure and the upper surface 66 of the annular encircling upper rim 24 of another closure 20 therebelow. Furthermore, this adequate spacing must be maintained about the entire periphery of the closures.

When two closures 20 are properly stacked, as illustrated in FIG. 5, the requisite spacing between closures, about their periphery, is maintained. With the closures centered with respect to one another, it is preferable that the upper sidewall portions 28 of adjacent closures are in columnar loading, and thereby the ribs are not necessary to maintain adequate spacing between adjacent stacked closures. The lower end of the lower sidewall portion 32 of the upper closure 20 rests on the upper end the lower sidewall portion 32 of the lower closure. With the vibrations and handling associated with automated packaging equipment, two closures may try to become slightly off-center with respect to one another.

One problem associated with stacked closures is that the downward pressure exerted on a lower closure 20 by a stack of closures thereabove sometimes causes the sidewall 26 of the lower closure 20 to be flexed radially outwardly to form a larger diameter section which allows the plug section 58 of the closure thereabove to drop down into the enlarged cavity 40 and to become wedged or jammed therein. The closure sidewalls 26 are relatively thin in thickness and quite wide in diameter, and are pliable because of this diameter, the thin wall thickness thereat, and the low density polyethylene material commonly employed.

Without the anti-jamming ribs 62, some particularly bad jamming of closures in a stack could occur. For instance, if the sealing surface 78 on the outer surface of the upper section 28 of the sidewall 26 of an upper closure was to wedge against the lower interior surface of the lower section 32 of a lower closure in the stack, this jamming would not only prevent the mechanical fingers from moving into a non-existent gap 72 between adjacent closure skirts but also would wedgingly lock the closures to each other and thus, be difficult to realign. The anti-jamming ribs 62 prevent this wedging interlock and also serve to easily realign the closures in the stack. If, when loading a stack of closures into the automatic capping machine's magazine, it is noticed that some of the closures are askew within the stack, the operator will run his hand along the edge of the stack raising and lowering the closures relative to one another, i.e., a riffling of the stack, whereupon the ribs 62 on one closure cam against the adjacent closure to realign the askew lid within the stack.

The rib means 62 prevent the plug section 58 of the closure thereabove from dropping down into the cavity 40 of the closure therebelow and thus prevents the closures from becoming wedged or jammed together. More specifically, the rib means 62 prevent the lower sidewall portion 32 of the closure 20 from sliding down into wedged engagement with the lower sidewall portion 32 of another closure 20 therebelow, and prevent the upper sidewall portion 28 of the upper closure 20 from wedging against the upper sidewall portion 28 of the lower closure.

Absent the rib means 62 of the present invention, upon the closures becoming off-center, the lower sidewall portion 32 of the upper closure 20 would slide off of the annular shelf 30 of the next lower closure 20, with the lower sidewall portions 32 of the closures abutting one another and closing the gap 72 between rims of adjacent closures. The rib means 62, extending outwardly beyond the lower sidewall portion 32, prevent this jamming. That is, with the stacked closures 20 slightly off-center and the lower sidewall portion 32 of the upper closure slid, say, inwardly of the lower sidewall portion 32 of the lower closure, the lower closure-engaging surface 68 of the rib means 62 would still be supported upon the upper surface 70 of the lateral offset portion 30, thereby preventing downward movement of the upper closure, and thus precluding jamming together of the closures.

However, with greater off-centering of stacked closures, such as illustrated in FIG. 4, the lower closure-engaging surface 68 of the rib means 62 may be slid inwardly of the lower sidewall portion 32 of the lower closure 20, as in FIG. 4. To facilitate self-centering of the upper closure 20 from the position of FIG. 4 to the position of FIG. 5, the outwardmost end 74 of the lower closure-engaging surface 68 is rounded, and the inner edge 38 of the lateral offset portion 30, at which the lower sidewall portion 32 and lateral offset portion 30 intersect, is also rounded at its inner edge 38. Hence, in this off-center position, rounded end 74 of the rib means 62 bears against rounded end 38 of the offset portion 30, with both rounded surfaces acting as mutual camming surfaces which bear against each other and a force applied to the stack allows the askew closure to be cammed into a centered alignment.

More specifically, with reference to FIG. 4, when the upper closure 20 shifts to the right, the left side of the closure drops down slightly with rounded surfaces 74 and 38 bearing against one another as described above. Simultaneously, the right side of the closure is shifted upwardly and to the right with the rounded end 74 of the rib means 62 on the right side of the upper closure being moved to a position at which it bears against the inner edge 34 of the annular upper rim 24. The weight of the upper closure, in addition to the weight of any further closures stacked thereabove, acts downwardly on the right side of the upper closure. The provision of the rounded end 74 on the rib means 62 provides a smooth bearing or camming surface against which the inner edge 34 of the rim 24 slides to allow the rib means 62 to slide downwardly and inwardly to its properly centered position. This movement on the right side of the closure 20 results in outward pushing of the rib means 62 on the left side of the closure 20. The rounded edge 74 of the left side rib means then bears against the rounded inner edge 38 of the lateral offset portion 30 of the lower closure which allows the left side of the upper closure to slide upwardly and outwardly to its centered position, as illustrated in FIG. 5.

By way of example only and not of limitation, closures were constructed having sixteen rib means 62 spaced uniformly about the external periphery of the closures. The outwardmost end 74 of the lower closure-engaging surface 68 of each of the rib means 62 was rounded, having a radius of curvature of 0.025 inch. The inner edge 38 of the lateral offset portions 30 was also rounded, having a radius of curvature of 0.045 inch. These radii were found to attain the desired self-leveling and self-centering effect, and no jamming problems occurred during tests of these closures. Tests were also run with closures having eight rib means, but such closures were found to be inferior to those having sixteen rib means. Better top-load support and very little side or lateral movement was realized with sixteen rib means as compared with embodiments having only eight rib means.

The tapered intermediate section 80 of the rib means 62 still further facilitates this self-centering and self-leveling. When the upper closure is more severely off-center, the rounded outwardmost end 74 of the lower closure-engaging surface 68 is moved inward of inner edge 38 of the lateral offset portion 30, as shown in FIG. 4. Thereupon, it is the intermediate rib section 80 which bears against edge 38, rather than the rounded end 74. With the intermediate rib section 80 tapered, as illustrated, there is an upward force component urging the upper closure 20 back to its centered position, whereas if the intermediate section 80 were vertical, there would be no such upward force component, and the closures would remain askew.

With the rib means 62 being small and residing on the underside of the closure 20, the aesthetic appearance of the closure is enhanced as compared with closures having ribs on their upper ends. Since with this design there are no ribs at the upper surface of the central circular panel 22, this design allows for printing over the entire upper surface of the central panel. Also, the elimination of rib means from the upper central panel 22 allows for easier clean-up of spillage onto the closure. Still further, the elimination of rib means from the upper surface of the central panel 22 allows factory packaging workers as well as consumers to press down on the top of the closure 20 to seal a container 50 without concern for the rib means cutting or scratching their fingers, which is currently a common complaint of packaging workers.

The closure 20 of the present invention lends itself to production by injection molding, and thus lends itself to inexpensive production.

While only specific embodiments of the invention have been described and shown, it is apparent that various alterations and modifications can be made therein. For instance, the shape and number of the rib means 62 may be altered to suit the specific requirements of a given application without departing from the inventive concepts of the invention. It is, therefore, the intention in the appended claims to cover all such modifications and alterations as may fall within the scope and spirit of the invention.

What is claimed is:

1. An injection molded closure for application to close a container having a sidewall with an exterior surface with an upper open end having a rim adjacent thereto, the closure comprising:

a plug-like portion having a central panel for substantially covering the open end of the container;

an encircling sidewall on the plug-like portion projecting upwardly from the central panel and having an exterior surface;

an encircling rim joined to an upper end of the sidewall of the plug-like portion;

a depending peripheral skirt joined to the encircling rim and spaced from the sidewall to define therewith a space into which the container rim may be inserted;

a retention bead on the peripheral skirt for cooperation with the container rim to hold the closure onto the container;

the encircling sidewall having an upper wall portion and a lower wall portion, an offset portion on the encircling sidewall extending radially inwardly from the upper wall portion to the lower wall portion;

a nesting surface on the closure for engagement with a nesting surface of an adjacent closure in a stack, to space the peripheral skirts of other adjacent closures from said encircling rim to define a gap into which mechanical fingers of automatic closure apparatus may be inserted; and a series of narrow anti-jamming ribs projecting radially outwardly from the exterior surface of the sidewall of the plug-like portion to support the closure in a stack, the anti-jamming ribs extending further radially outwardly adjacent and below said offset portion than adjacent a bottom of said lower wall, for preventing jamming of the closure with a closure therebelow and having means for assisting in realigning the closure in the stack if it is askew in the stack.

2. A closure in accordance with claim 1 in which an offset portion is formed on the sidewall of the plug-like portion, the anti-jamming ribs being located beneath the offset portion.

3. A closure in accordance with claim 1 in which the ribs are disposed within the container and hidden from view when the closure is applied to a container.

4. An injection molded closure for application to close a container having a sidewall with an upper open end having a rim adjacent thereto, the closure comprising:

a plug-like portion having a central panel for substantially covering the open end of the container;

an encircling sidewall on the plug-like portion projecting upwardly from the central panel and having an exterior surface;

an encircling rim joined to an upper end of the sidewall of the plug-like portion;

a depending peripheral skirt joined to the encircling rim and spaced from the sidewall to define therewith a space into which the container rim may be inserted;

a retention bead on the peripheral skirt for cooperation with the container rim to hold the closure onto the container;

upper and lower nesting surfaces on the closure for engagement with nesting surfaces of an adjacent closure in a stack to space the peripheral skirt of other adjacent closures from said rim to define a gap into which mechanical fingers of an automatic closure apparatus may be inserted;

anti-jamming ribs formed on the exterior surface of the sidewall of the plug-like portion to support the closure in a stack and to prevent jamming of the closure with a closure therebelow and to assist in realigning the closure in the stack if it is askew in the stack;

an offset portion formed on the sidewall of the plug-like portion, the anti-jamming ribs being located beneath the offset portion and;

the anti-jamming ribs having a pair of upper and lower nesting surfaces, the upper nesting surface of the ribs for engaging the rim of another closure therebelow, the lower nesting surface of the ribs for engaging the offset portion of a closure stacked therebelow.

5. A closure in accordance with claim 4 in which an inner corner on the rim is positioned to abut substantially vertical walls on the ribs to prevent radial inward shifting of adjacent lids.

6. A combination of a closure and a container for packaging dairy products with an automatic closure apparatus having mechanical fingers, the combination comprising:

the container having an upwardly projecting sidewall;

an encircling upper rim on the sidewall defining an opening into the container and for connection to the closure;

a plug-like portion having a central panel for substantially covering the open end of the container;

a continuous encircling sidewall on the plug-like portion projecting upwardly from the central panel and having an exterior surface;

an encircling rim joined to an upper end of the sidewall of the plug-like portion;

a depending peripheral skirt joined to the encircling rim and spaced from the sidewall to define therewith a space into which the container rim may be inserted;

a retention bead on the peripheral skirt for cooperation with the container rim to hold the closure onto the container;

upper and lower nesting surfaces on the closure for engagement with nesting surfaces of an adjacent, superimposed closure to space the peripheral skirt of the superimposed other closure from said encircling rim to define a gap into which said mechanical fingers of said automatic closure apparatus may be inserted; and a plurality of thin, discrete vertically oriented anti-jamming ribs formed of solid plastic and projecting radially outwardly of the exterior of the sidewall of the plug-like portion and extending upwardly along a substantial portion of the encircling sidewall and being disposed within the container and in engagement therewith.

7. A closure for application to a container having a container wall engageable by an automatic closure apparatus having mechanical fingers, the container having a sidewall with closure engaging means at an upper end of the container, defining an open mouth with a rim adjacent thereto, the closure comprising:

a central circular panel for substantially covering an open container;

a plug-like portion upwardly extending from the central circular panel, for insertion into the open mouth of the container for sealing engagement with the container wall, said plug-like portion having a generally upright continuous sidewall with an upper end, said sidewall defining an upwardly-facing cavity bounded at its upper end by an annular portion of said sidewall;

said upright sidewall having a substantially vertical upper wall portion and a substantially vertical lower wall portion having a bottom side and being offset radially inwardly from the upper wall portion, with a lateral offset portion, having a top side, interconnecting the upper wall portion and the lower wall portion;

the top side of the lateral offset portion defining an upper nesting surface;

the bottom side of the lower wall portion defining a lower nesting surface;

an encircling rim on the closure extending radially outwardly from the upright sidewall and having an outer depending skirt with a bead thereon for locking engagement with the container rim;

said nesting surfaces engaging with an adjacent closure to define a gap between adjacent encircling rims of adjacent closures into which gap said mechanical fingers of said automatic closure apparatus may be inserted;

said lower nesting surface of said closure engaging the upper nesting surface of another closure stacked therebelow and the upper nesting surface of said closure engaging the lower nesting surface of another closure stacked thereabove;

the lower wall portion having an exterior surface and a plurality of spaced-apart solid ribs extending substantially along the length of the lower wall portion of the closure and projecting radially outwardly from said exterior surface of said lower wall portion of said upright sidewall for contact with another plug-like portion of another closure at a plurality of spaced contact points when the plug-like portion of the closure is inserted into the cavity of another closure, so as to prevent a wedged engagement of the closure sidewall with the plug-like portion of said other closure stacked therewith.

8. The closure of claim 7 wherein said rib means extend along at least a portion of said lower wall portion and said lateral offset portion of said upright sidewall.

9. The closure of claim 7 wherein said rib means includes approximately sixteen ribs, spaced generally uniformly about the closure.

10. A closure for application to a container having a sidewall and a upper end, the container having closure engaging means at its upper end defining an open mouth having a rim adjacent thereto, the closure comprising:

a central circular panel for substantially covering an open container;

a plug-like portion upwardly extending from the central circular panel, for insertion into the open mouth of the container for sealing engagement with the container sidewall, said plug-like portion having a generally upright sidewall defining an upwardly-facing cavity bounded at its upper end by an annular portion of said sidewall;

said upright sidewall having a substantially vertical upper wall portion and a substantially vertical lower wall portion having a bottom side and being offset radially inwardly from the upper wall portion, with a lateral offset portion having a top side interconnecting the upper wall portion and the lower wall portion;

an upper nesting surface on the top side of the lateral offset portion;

a lower nesting surface on the bottom side of the lower wall portion;

an encircling rim on the closure extending radially outwardly from the sidewall and having an outer depending skirt with a bead thereon for locking engagement with the container rim;

said lower nesting surfaces engaging with an adjacent closure to define a gap between adjacent encircling rims of adjacent closures into which gap mechanical fingers of an automatic closure may be inserted;

said lower nesting surface of said closure engaging the upper nesting surface of another closure stacked therebelow and the upper nesting surface of said closure engaging the lower nesting surface of another closure stacked thereabove; and a plurality of spaced-apart rib means outwardly extending from said sidewall for contact with another plug-like portion of another closure at a plurality of spaced contact points when the plug-like portion of the closure is inserted into the cavity of another closure, so as to prevent closure of the gap thereby preventing insertion of the mechanical fingers into the gap; and said encircling rim having an upper surface and said rib means including an upper closure-engaging surface for contact with the encircling rim upper surface of another closure therebelow, and said rib means further including a lower closure-engaging surface for contact with the upper nesting surface of said other closure therebelow.

11. The closure of claim 10 wherein said lateral offset portion, and said rib means upper and lower closure-engaging surfaces, extend substantially parallel to said central circular panel.

12. The closure of claim 11 wherein said rib means include a tapered intermediate section tapering inwardly from said upper closure-engaging surface toward said lower closure-engaging surface.

13. The closure of claim 12 wherein said tapered intermediate rib means section of said closure bears against one of the lower sidewall and lateral offset sidewall sections of another non-centered closure therebelow.

14. The closure of claim 12 wherein the sidewall lateral offset portion and lower wall portion intersect one another along an intersection which is arcuate to define an arcuate lower self-aligning surface, and the intersection of said rib means lower closure-engaging surface and tapered intermediate section is arcuate to define an arcuate upper self-aligning surface, with the arcuate upper self-aligning surface of said closure bearing and camming against the arcuate lower self-aligning surface of another non-centered closure therebelow to facilitate self-centering of said closures.

15. The closure of claim 14 wherein the radius of curvature of the lower self-aligning surface is greater than the radius of curvature of the upper self-aligning surface.

16. The closure of claim 15 wherein the radius of curvature of the lower self-aligning surface is approximately 1.8 times greater than the radius of curvature of the upper self-aligning surface.

17. The closure of claim 10 wherein the central circular panel of said closure has a bottom surface and said lower closure-engaging surface of said rib means is substantially co-planar with said bottom surface of said circular panel.

18. An injection molded plastic closure for application to a container having a sidewall and an upper end, with a radially outwardly projecting bead at its upper end defining an open mouth, the closure comprising:

a horizontal annular rim having a radially inward edge and a radially outward edge;

a peripheral skirt depending generally downwardly from the radially outward edge of the annular rim and terminating at a lower edge having a radially inwardly projecting bead;

a continuous upper annular closure sidewall section depending generally downwardly from the radially inward edge of the annular rim and terminating at a lower edge;

a continuous annular offset section extending generally radially inwardly from the lower edge of the upper annular sidewall, and terminating at a radially inward edge;

a continuous lower annular closure sidewall section depending generally downwardly from the radially inward edge of the annular offset section and terminating at a lower edge;

an exterior vertical surface on the lower annular closure sidewall section;

a horizontally extending central circular panel integral with the lower edge of the lower annular closure sidewall;

an exterior surface on the annular offset section facing downwardly;

a plurality of peripherally spaced solid ribs integral with both said annular offset section and said lower sidewall section and extending radially outwardly from the exterior vertical surface on the lower annular closure sidewall section and extending downwardly from the exterior surface of the annular offset section for contact with a portion of an upper surface of another closure therebelow to maintain spacing between the closure and said other closure therebelow about the peripheries of the closures for accommodation of mechanical packaging equipment.

19. An injection molded plastic closure for application to a container having a sidewall with an upper end, and with a radially outwardly projecting bead at its upper end defining an open mouth, the closure comprising:

a horizontal annular rim having a radially inward edge and a radially outward edge;

a peripheral skirt depending generally downwardly from the radially outward edge of the annular rim and terminating at a lower edge having a radially inwardly projecting bead;

an upper annular closure sidewall section depending generally downwardly from the radially inward edge of the annular rim and terminating at a lower edge;

an annular offset section extending generally radially inwardly from the lower edge of the upper annular sidewall, and terminating at a radially inward edge;

a lower annular closure sidewall section depending generally downwardly from the radially inward edge of the annular offset section and terminating at a lower edge;

a horizontally extending central circular panel integral with the lower edge of the lower annular closure sidewall;

a plurality of peripherally spaced rib means extending radially outwardly from the lower annular closure sidewall for contact with a portion of an upper surface of another closure therebelow to maintain spacing between the closure and said other closure therebelow about the periphery of the closures for accommodation of mechanical packaging equipment; and said peripherally spaced rib means comprising an upper closure-engaging surface and a lower closure-engaging surface, with the upper closure-engaging surface of the rib means bearing against an upper portion of said closure therebelow, and the lower closure-engaging surface of the rib means bearing against a lower portion of said closure therebelow.

20. A plastic molded container and closure assembly for use with an automatic closure apparatus having mechanical fingers, the assembly comprising:

a) a container having an encircling container wall defining an upper open end;

an annular rim on the upper open end of said container wall; and b) a closure comprising:

a plug-like portion having a central panel for substantially covering the open end of the container, and having a continuous sidewall extending generally upwardly from the periphery of the central panel;

an encircling rim joined to an upper end of the sidewall of the plug-like portion;

a depending peripheral skirt joined to the encircling rim and spaced from the sidewall to define therewith a space into which the container rim may be inserted;

a retention bead on the peripheral skirt for cooperation with the container rim to hold the closure onto the container;

upper and lower nesting surfaces on the closure for engagement with nesting surfaces of an adjacent closure in a stack to space the peripheral skirt of the other adjacent closure from said encircling rim to define a gap into which said mechanical fingers of said automatic closure apparatus may be inserted; and anti-jamming ribs formed of solid plastic and projecting radially outwardly of an exterior surface of the sidewall of the plug-like portion having anti-jamming and self-centering means to support the closure against jamming with another closure and to assist in maintaining the closure in centered relation with another closure.

* * * * *

UNITED STATES PATENT AND TRADEMARK OFFICE

CERTIFICATE OF CORRECTION

PATENT NO. : 5,377,861

DATED : January 3, 1995

INVENTOR(S) : Landis

It is certified that error appears in the above-indentified patent and that said Letters Patent is hereby corrected as shown below:

IN THE CLAIMS:

Column 10, line 17, change "skirt" to --skirts--.

Column 10, line 29, change "and;" to --; and--.

Column 12, line 3, after "closure" insert --periphery--.

Signed and Sealed this

Sixth Day of June, 1995

Bruce Lehman

*Attest:*

BRUCE LEHMAN

*Attesting Officer*

*Commissioner of Patents and Trademarks*